United States Patent [19]

Anderson et al.

[11] 4,011,830

[45] Mar. 15, 1977

[54] RIBBON INKING MACHINE

[75] Inventors: Frank R. Anderson, Hacienda Heights; Albert J. Castro, Cudahy, both of Calif.

[73] Assignee: Westates Space-Era Products, Inc., S. El Monte, Calif.

[22] Filed: May 12, 1975

[21] Appl. No.: 576,599

[52] U.S. Cl. ..... 118/60; 118/235; 188/67

[51] Int. Cl.[2] ..... B05C 1/08; B05C 9/14

[58] Field of Search ..... 118/60, 235; 188/67, 188/77; 100/219

[56] References Cited

UNITED STATES PATENTS

| | | | |
|---|---|---|---|
| 956,602 | 5/1910 | Pulsifer | 118/60 |
| 2,773,568 | 12/1956 | Ragland | 188/77 R |
| 3,099,023 | 7/1963 | Buchholz et al. | 188/67 X |
| 3,230,714 | 1/1966 | Redfield | 188/67 X |
| 3,731,649 | 5/1973 | Anderson et al. | 118/60 X |

*Primary Examiner*—John P. McIntosh
*Attorney, Agent, or Firm*—Edward D. O'Brian

[57] ABSTRACT

The subject matter of this specification pertains to improvements intended to be utilized in a ribbon inking machine having a frame, a drum mounted on the frame, a carriage movably mounted on the frame so as to be capable of being used with respect to the drum, a ribbon feed roller mounted on the carriage, a ribbon inking structure mounted on the carriage, and a ribbon takeup roller mounted on the frame. Such a machine is preferably constructed to include a pressing element mounted on guide rods so as to be capable of being moved towards and away from the drum. Solenoids are used to control the tension on bands mounted on the pressing element and passing around the guide rods. When they are tightened they hold the pressing element relative to the guide rods. A mechanical mechanism provided for raising and lowering the pressing element is located on the guide rods. Although this mechanism and these bands are intended for use in a ribbon inking machine as described it is considered that other uses will be found for them.

6 Claims, 5 Drawing Figures

RIBBON INKING MACHINE

CROSS REFERENCE TO RELATED PATENTS

Anderson et al. U.S. Pat. No. 3,731,649 issued May 8, 1973 entitled "Ribbon Inking Machine;" Anderson et al. U.S. Pat. No. 3,733,211 issued May 15, 1973 entitled "Ribbon Inking Method."

BACKGROUND OF THE INVENTION

The invention set forth in this specification is primarily directed to improvements which are primarily intended to be utilized in combination in ribbon inking machines.

For many years it has been customary to throw out and replace inked ribbons as are commonly utilized in connection with various types of computing, calculating, addressing and related machines after the ink within such ribbons has been consumed or exhausted as the result of prolonged use of such ribbons. To a large extent it is considered that economy can be achieved by re-inking such ribbons after they have been used.

Preferably such ribbons have been re-inked utilizing a method in which ink is applied to such ribbons and in which such ribbons are then heated to a moderate extent sufficient to lower the viscosity of the ink applied so as to tend to cause such ink to permeate such ribbons and to a sufficient extent so that any thermoplastic material within such ribbons which has been stretched from an initial shape as a result of prolonged use tends to assume its initial configuration. In order to achieve the last result it has been considered necessary to hold a ribbon under tension as it is heated.

Unquestionably prior machines for re-inking ribbons as indicated in the preceding have been highly utilitarian and serviceable. Unfortunately, however, these machines have tended to be somewhat limited in their utilization because of several different factors. One of these is that such machines have normally been constructed so that the speed at which a ribbon passes over a heating structure will vary depending upon the diameter of a roll of ribbon being inked. This is considered disadvantageous since it results in a portion of a ribbon which is being re-inked being subjected to either a greater or lesser amount of heat than other portions of the same ribbon. This will cause unequal permeation of the ink applied to such a ribbon into the interstices of a ribbon. It will also tend to result in uneven shrinking of a stretched ribbon along the length of a ribbon back to or towards its initial configuration. Such prior machines have also been somewhat limited in their suitability for use with ribbons of various different thicknesses.

SUMMARY OF THE INVENTION

From the foregoing it will be apparent that there is need for improvement in the field of re-inking ribbons such as are used in various types of business machines. A broad objective of the present invention is to fulfill this need. More specifically the invention is directed towards supplying new and improved ribbon inking machines.

The invention is intended to provide ribbon inking machines which will uniformly ink and heat an elongated ribbon at all points along the length of such a ribbon. The invention is also intended to provide ribbon inking machines which will accommodate ribbons of different thicknesses automatically without adjustment. Further objectives of the invention are to provide ribbon inking machines which can be constructed at a comparatively nominal cost using many stock parts and which are capable of performing reliably for a prolonged period with little or no maintenance.

The invention is also concerned with new and improved means for holding a movable element relative to guides permitting the element to be moved in a linear path. The invention is also concerned with a structure which can be utilized in order to mechanically move such an element along such guides. In accordance with this invention such means and such a mechanical structure are preferably included within a ribbon inking machine as indicated in the preceding discussion.

Certain of the above noted objectives of the invention are achieved by providing in a ribbon inking machine having a frame, a drum mounted on said frame, a carriage movably mounted on said frame so as to be capable of being moved toward and away from the drum, a ribbon feeding means mounted on the carriage, a ribbon inking means mounted on the carriage, and a ribbon takeup means mounted on the frame, the improvement which comprises: guide rod means located adjacent to the drum, a pressing element mounted on the guide rod means so as to be capable of being moved on the guide rod means toward and away from the drum, flexible band means located on the pressing element so as to extend around the guide rod means, tightening means for tightening the band means relative to the guide rod means so as to position the pressing element in a desired position with respect to the guide rod means and mechanical means for moving the pressing element with respect to the drum and guide rod means, the mechanical means being capable of being used to space the pressing element away from the drum.

BRIEF DESCRIPTION OF THE DRAWINGS

The invention is best more fully discussed by referring to the accompanying drawings in which.

Figure 1:
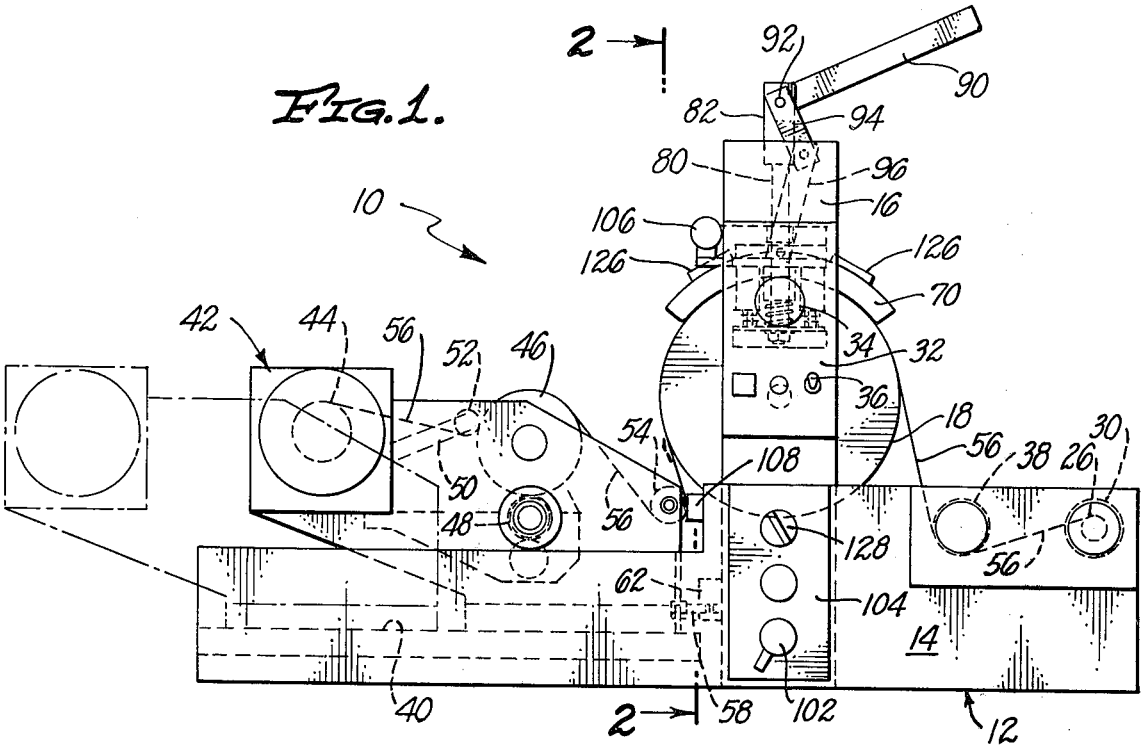
FIG. 1 is a side elevational view of a presently preferred embodiment of a ribbon inking machine in accordance with this invention.
Figure 2:
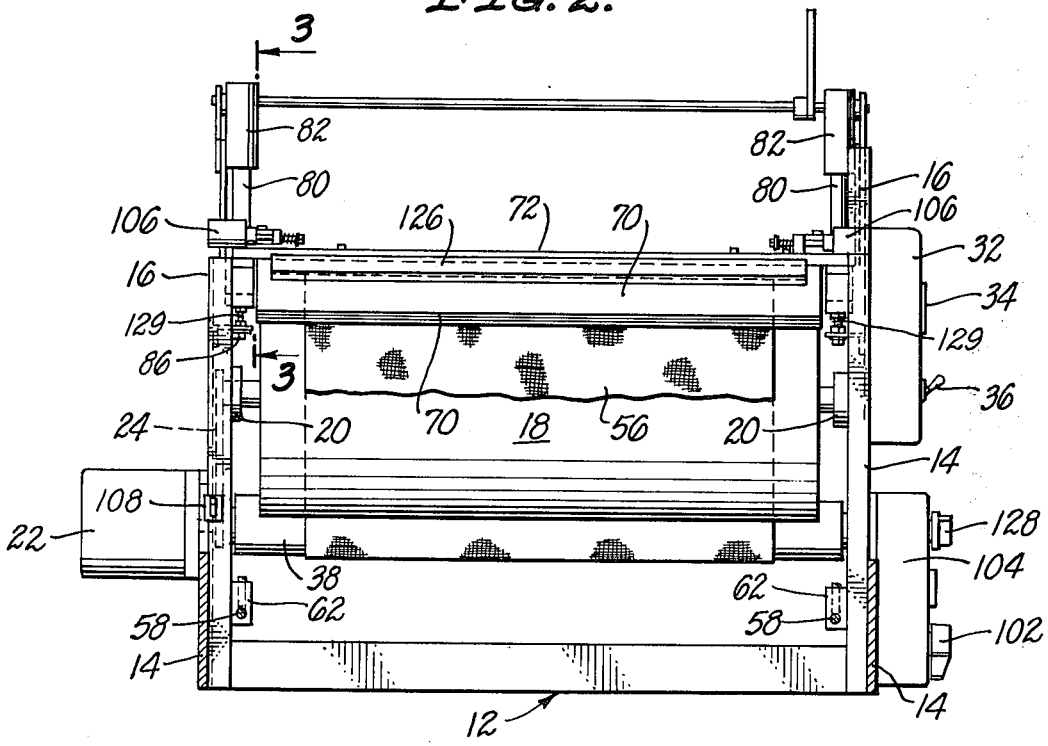
FIG. 2 is a cross-sectional view taken of line 2—2 of FIG. 1.
Figure 5:
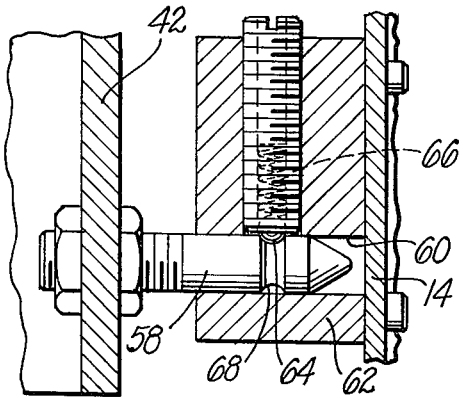
FIG. 5 is a partial cross-sectional view showing the construction of a detent latch employed in conjunction with the machine illustrated in the preceding figures.

The concepts of the invention which are considered to be entitled to protection are set forth and defined in the appended claims forming a part of the disclosure of this specification. It will be realized that these concepts can be easily embodied in a variety of differently appearing structures through the use or exercise of routine engineering skill.

DETAILED DESCRIPTION

In the drawings there is shown a ribbon inking machine 10 in accordance with the concepts of this invention. In many respects the construction of this machine is related to the construction of the machine illustrated in the Anderson et al. U.S. Pat. Nos. 3,731,649 and 3,733,211. In the interest of brevity the entire disclosures of both of these U.S. patents are incorporated herein by reference for the purpose of indicating prior structures and prior known practice in connection with the re-inking of business machine ribbons.

The machine 10 includes a frame 12 having sides 14 spaced from one another. These sides 14 have upwardly extending extensions 16 which carry a rotatable drum 18 in a conventional manner so that this drum 18 is supported by bearings 20 located on the extension 16. This drum 18 is adapted to be driven by a small motor 22 connected to the drum 18 by a conventional power transmission mechanism 24. This motor 22 is also adapted to rotate a takeup roller 26 through the use of another conventional drive mechanism 28. This roller 26 is preferably mounted on slip clutches 30.

An appropriate conventional control box 32 is provided on one of the extensions. Through the adjustment of a control knob 34 on this box 32 the drum 18 may be rotated at various different speeds as desired. An on/off switch 36 on the box 32 is used to turn the motor 22 on or off. The box 32 is connected to the motor 22 in a conventional manner (not shown).

The sides 14 also support a water cooled chilling roller 38 in such a manner that the axis of this roller 38 is parallel to the axis of the drum 18 and the roller 26. The sides 14 also support parallel ways 40. These ways 40 in turn support a movable carriage 42 in such a manner that this carriage 42 can be moved back and forth relative to the drum 18 between the position shown in solid lines in FIG. 1 and the position shown in phantom in FIG. 1. It will be noted that at all times the carriage 42 is parallel to the axis of the drum 18.

This is to permit a ribbon pay off roller 44 and an ink applicator roller 46 on the carriage 42 to remain parallel to the axis of the drum 18 at all times. This carriage 42 also transfers a roller 48 which is contacted by the applicator roller 46 so as to meter on to the applicator roller 46 a uniform film of ink. The carriage 42 also supports two pivotally mounted arms 40 which carry an idler roller 52 as shown in FIG. 1 of the drawings. The carriage 42 also supports another idler roller 54.

The various rollers 44, 46, 48, 52 and 54 are all constructed in a known or conventional manner. None of these rollers on this carriage 42 are directly connected to any mechanical source of power. In the machine 10 they are caused to turn as a length of ribbon 56 is pulled through the machine as the result of frictional contact with the drum 18. This ribbon 56 comes off the ribbon pay off roller 44 and passes beneath the idler roller 52 and then around a part of the applicator roller 46 and then beneath the idler roller 54. From this idler roller 54 the ribbon 56 passes upwardly around the drum 18 and then beneath the water cooled, chilling roller 38 to the takeup roller 26.

The idler roller 52 is used merely to assure a desired contact between the ribbon 56 and the applicator roller 46 so that there will be adequate time for ink to transfer to the ribbon 56 from the applicator roller 46 and so that there will be adequate frictional contact to turn the applicator roller 46 in such a manner that the frictional contact between it and the transfer roller 48 will cause rotation of the transfer roller 48; such rotation actuates this transfer roller 48 to dispense and transfer ink to the applicator roller 46.

As the machine 10 is being set up for use the carriage 42 will normally be in a position as shown in phantom at the left of FIG. 1. When the carriage 42 is in this position there is adequate access to it to permit servicing and to permit a full ribbon pay off roller 44 containing a ribbon 56 to be inked to be located upon it. After such a roller 44 has been located in place the carriage 42 will be moved toward the position as shown in full lines in FIG. 1.

When the carriage 42 reaches this position a small, elongated retainer pin 58 mounted on the carriage 42 will move into a small hole 60 in a block 62 mounted on the frame 12. When the pin 58 is in this position a ball 64 will be biased by a spring 66 so as to fit against a groove 68 in the pin 58 in such a manner as to detachably latch or hold the carriage 42 in an operative position. This structure involving the pin 58 and the ball 64 can be regarded or termed a detent mechanism for holding the carriage 42 in an operative position relative to the frame 12.

When the carriage 42 is manipulated in the manner described a pressing element 70 will normally be in a position in which it is spaced from the drum 18. This pressing element 70 is mounted upon an elongated plate 72 by means of conventional fasteners 74 at both ends of the plate 72 in such a manner that it can "rock" back and forth a limited amount relative to the plate 72. This facilitates alignment of the element 70 when it is moved relative to the drum 18 so that it is congruent to the drum 18.

The plate 72 includes terminal holes 76 and cylindrical bushings 78 mounted on the plate 72 beneath the holes 76. These holes 76 and these bushings 78 are employed to slidably mount the plate 72 and the pressing element 70 upon guide rods 80 which depend from supports 82 mounted on the sides 14. These guide rods 80 carry enlarged washers 84 and nuts 86. Normally this plate 72 will be biased upwardly by small coil springs 88 around the rods 80 engaging the washers 84 and the bushings 78. Conventional adjustable stops 129 carried by the plate 72 serve to limit downward movement of the plate 72 by hitting against the washers 84.

The position of the plate 72 can be manually manipulated through the use of a handle 90 secured to a rocker shaft 92 which is rotatably mounted on the supports 82. Each end of the shaft 92 carries a small crank arm 94 which is connected to an end of the plate 72 by a link 96. With this structure when the handle 90 is rotated counter-clockwise from its position as indicated in FIG. 1 the arms 94 will be correspondingly rotated and this in turn will move the links 96 upwardly in such a manner as to cause upward movement of the plate 72. As such rotation of the handle 90 is continued the links 96 will pass through an "over center" position relative to the crank arms 94. In such an over center position the arms 94 and the links 96 will be parallel. After these arms 94 and links 96 pass through this position the normal action of gravity will tend to pull the plate 72, the arms 94 and the links 96 downwardly to a point where notches 98 on the arms 94 will be engaged by pins 100 on the supports 82. Such engagement will then hold the plate 72 against downward movement in a position in which the pressing element 70 is spaced from the drum 18.

Such spacing will allow the ribbon 56 from the carriage 42 to be passed around the drum 18 and under the chilling roller 38 to the takeup roller 26. This ribbon 56 will of course normally be attached to this takeup roller 26 at this point so that it can be wound around it as the machine 10 operates. Before the machine 10 is operated, however, the handle 90 will be rotated back to its original position and released.

This of course will lower the pressing element 70 so that this element will move toward the drum 18, tending to push the ribbon 56 into contact with the drum 18. Only enough pressure to collapse springs 88 will be used to move the plate 72 and the pressing element 70 against the ribbon 56 and the drum 18. Because the guide rods 80 have smooth exteriors this action will serve to position the pressing element 70 in a desired operative manner with respect to a ribbon 56 of any commonly utilized thickness. This is important since it avoids having to utilize special means to gauge the thickness of a ribbon 56 and to adjust the machine 10 to accommodate any change in the thickness of one ribbon over another.

When the pressing element 70 is so positioned normally a control switch 102 mounted upon a control box 104 on one of the sides 14 will be actuated so as to actuate two solenoids 106 mounted on the ends of the plate 72 and drive motor 22. This switch 102 is preferably connected in a conventional manner (not shown) to these solenoids 106 and to another switch 108 on the frame 12 in such a position as to be engaged and closed by the carriage 42 when the carriage 42 is in a position as shown in FIG. 1. This switch 108 serves in a conventional manner to "block" the operation of the switch 102 to actuate the solenoids 106 unless the carriage 42 is in an operative position as shown.

When the switch 102 is actuated so as to actuate the solenoids 106 the armatures 110 on these solenoids 106 move inwardly relative to these solenoids 106. This brings coil springs 112 on these armatures into contact with rocker arms 114 mounted on the plate 72 by means of pivots 116. These arms 114 have cylindrical ends 118. A flexible band 120 extends in essentially an S-shaped path around each of the ends 118 and around an adjacent guide rod 80. These bands 120 are attached by fasteners 122 to the arms 114 and to blocks 124 on the plate 72.

When the solenoids 106 are actuated in this manner these bands 120 are tightened with respect to the rods 80 so as to hold the plate 72 and the pressing element 70 in the positions allowed by stops 129 as a result of movement of the handle 90. Hence, these bands 120 and the various parts associated with them are a locking or holding means for locking or holding the pressing element 70 in the desired operative position. This, of course, avoids having to adjust the locking structure employed each time a ribbon 56 of a different thickness is processed.

During such processing conventional heater elements 126 on the pressing element 70 will be actuated through the actuation of an electrical control 128 on the box 104 so as to supply a desired amount of heat to the pressing element 70 and to the ribbon 56 as this ribbon 56 passes between the pressing element 70 and the drum 18. These elements 126 and 128 are connected in a conventional manner; as the ribbon 56 passes from the drum 18 it will be cooled back to room temperature or below by passing under the chilling roller 38. Because of the method of operation involved here in heating the ribbon 56 and in winding it there will be absolutely no tendency to stretch the ribbon 56 so that it necks down or reduces its width, and the constant drum 18 speed will reink evenly regardless of ribbon length.

After the ribbon 56 processed in the manner noted is completely wound upon the takeup roller 26 the tension on this ribbon 56 will gradually increase between rollers 18 and 54. This will apply rearward force to the idler roller 54 used on the carriage 42 for the purpose of controlling the angle that the ribbon 56 travels as it is being processed. Such force on the roller 54 will cause the carriage 42 to be moved away from the drum 18 and will spring the pin 58 loose from the block 62. As this occurs the switch 108 will be disengaged and will open. This will have the effect of stopping the current supplied to the solenoids 106 and the driving motor 22. When this occurs the armatures 110 of the solenoids 106 will move so as to loosen the bands 120 and driving motion stops. The springs 88 will then move the element 70 upwardly. At this point an operator will normally take over so that the machine 10 will be used in inking or re-inking another ribbon.

We claim:

1. In a ribbon inking machine having a frame, a drum mounted on said frame, a carriage movably mounted on said frame so as to be capable of being moved towards and away from said drum, a ribbon feeding means mounted on said carriage, ribbon inking means mounted on said carriage, and ribbon takeup means mounted on said frame the improvement which comprises:

guide rod means located adjacent to said drum, a pressing element mounted on said guide rod means so as to be capable of being moved on said guide rod means towards and away from said drum, flexible band means located on said pressing element so as to extend around said guide rod means, tightening means for tightening said band means relative to said guide rod means so as to position said pressing element in a desired position with respect to said guide rod means, and mechanical means for moving said pressing element with respect to said drum and said guide rod means, said mechanical means being capable of being used to space said pressing element away from said drum.

2. A ribbon inking machine as claimed in claim 1 wherein:

said guide rod means comprise two parallel guide rods, said flexible band means comprise two separate bands, each of said bands having an end secured to said pressing element and an end secured to said tightening element.

3. A ribbon inking machine as claimed in claim 2 wherein:

there are two of said tightening means each of which is associated with one of said bands, each of said tightening means comprising an arm rotatably mounted on said pressing element and a rotating means for rotating said arm, an end of each of said bands being attached to the arm of the tightening means associated therewith.

4. A ribbon inking machine as claimed in claim 1 wherein:

said mechanical means include a crank arm means rotatably mounted on said frame and link means connecting said crank arm means with said pressing element and crank means for rotating said crank arm means, said frame and said crank arm means being shaped so as to permit said crank arm means to be rotated past an over center position relative to said link means in which said crank arm means is blocked from further rotation by contact with said frame.

5. A ribbon inking machine as claimed in claim 1 wherein:

said guide rod means comprise two parallel guide rods, said flexible band means comprise two separate bands, each of said bands having an end secured to said pressing element and an end secured to said tightening element, there are two of said tightening means each of which is associated with one of said bands, each of said tightening means comprising an arm rotatably mounted on said pressing element and a rotating means for rotating said arm, an end of each of said bands being attached to the arm of the tightening means associated therewith, said mechanical means include a crank arm means rotatably mounted on said frame and link means connecting said crank arm means with said pressing element and crank means for rotating said crank arm means, said frame and said crank arm means being shaped so as to permit said crank arm means to be rotated past an over center position relative to said link means in which said crank arm means is blocked from further rotation by contact with said frame.

6. In a ribbon inking machine having a frame, a drum mounted on said frame, a carriage movably mounted on said frame so as to be capable of being moved towards and away from said drum, a ribbon feeding means mounted on said carriage, ribbon inking means mounted on said carriage, and ribbon takeup means mounted on said frame the improvement which comprises:

guide rod means located adjacent to said drum, a pressing element mounted on said guide rod means so as to be capable of being moved on said guide rod means towards and away from said drum, means for holding said pressing element against movement on said guide rod in any position of said pressing element relative to said guide rod means, said means for holding being mounted on said pressing element and being capable of being actuated so as to engage said guide rod means, and mechanical means for moving said pressing element with respect to said drum and said guide rod means, said mechanical means being capable of being used to space said pressing element away from said drum.

* * * * *

UNITED STATES PATENT OFFICE

CERTIFICATE OF CORRECTION

PATENT NO. :4,011,830

DATED :MARCH 15, 1977

INVENTOR(S) :FRANK R. ANDERSON and ALBERT J. CASTRO

It is certified that error appears in the above-identified patent and that said Letters Patent are hereby corrected as shown below:

Column 4, line 38, --a plate 130 carried by-- should be inserted after the word "against".

Figure 3:
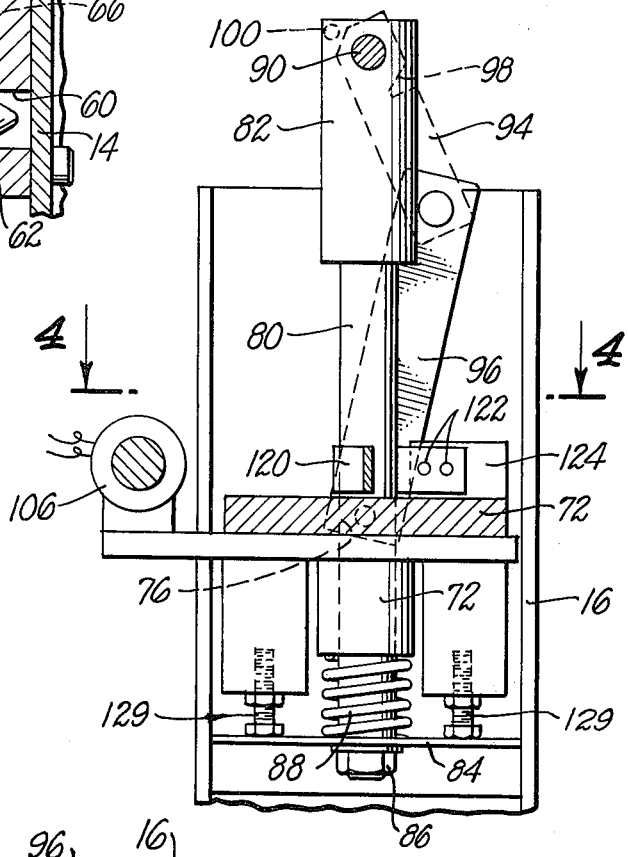
FIG. 3 is an enlarged partial cross-sectional view taken at line 3—3 of FIG. 2.
Figure 4:
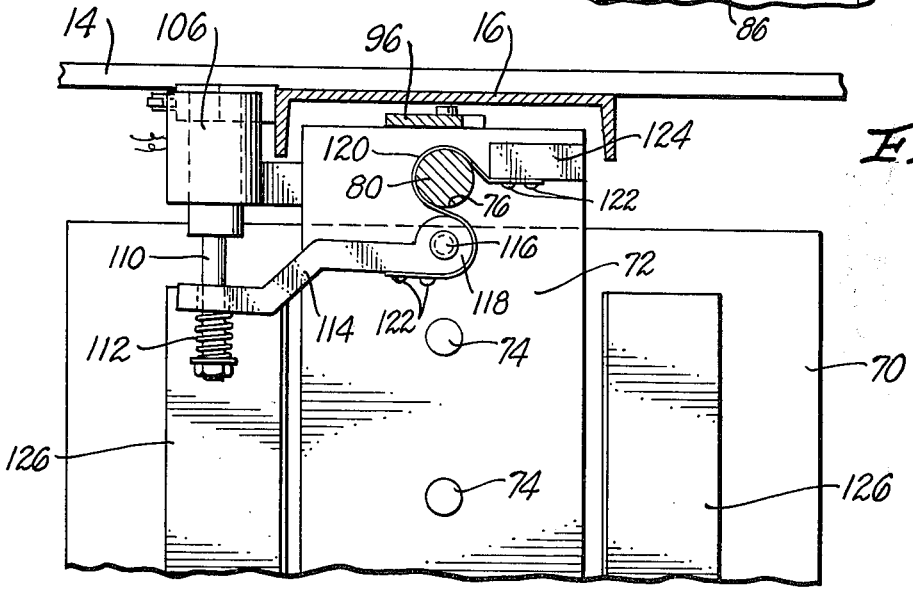
FIG. 4 is a partial cross-sectional view taken at line 4—4 of FIG. 3.

In Fig. 3 of the drawing, the numeral "72" as used slightly below the center of the drawing should be the numeral --78--.

In Fig. 3 of the drawing, the lead line from the numeral "84" should clearly designate the washer 84 above the nut 86.

In Fig. 3 of the drawing, the numeral --130-- should be inserted so as to designate the part previously designated by the numeral "84".

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*